US007931248B2

(12) United States Patent
Korwin-Edson et al.

(10) Patent No.: US 7,931,248 B2
(45) Date of Patent: Apr. 26, 2011

(54) FLAT MOLD FOR CORNER-SHAPED SIMULATED STONE PRODUCTS

(75) Inventors: Michelle L. Korwin-Edson, Pataskala, OH (US); Douglas H. Walden, Newark, OH (US); Robert E. Embrey, Newark, OH (US); Larry E. Targett, Pickerington, OH (US)

(73) Assignee: Boral Stone Products LLC, Roswell, GA (US)

( * ) Notice: Subject to any disclaimer, the term of this patent is extended or adjusted under 35 U.S.C. 154(b) by 220 days.

(21) Appl. No.: 11/319,675

(22) Filed: Dec. 28, 2005

(65) Prior Publication Data

US 2007/0145642 A1 Jun. 28, 2007

(51) Int. Cl.
*B22C 9/06* (2006.01)
*B44F 9/04* (2006.01)

(52) U.S. Cl. ..... 249/55; 249/69; 249/127; 428/15; 428/409

(58) Field of Classification Search ..... 249/55, 249/69, 81, 114.1, 127, 134; 199/55, 91; 428/15, 409, 412; D15/135, 136; D25/102, D25/113, 119, 151; 52/284, 596; 246/225, 246/297.9; 425/385, 425, 403
See application file for complete search history.

(56) References Cited

U.S. PATENT DOCUMENTS 583,515 A 6/1897 Stevens
779,979 A 1/1905 Walter
962,924 A 6/1910 Simpson
1,038,115 A 9/1912 Gillies
1,766,930 A 6/1930 Nicholas
2,819,495 A 1/1958 Krausz
2,834,052 A 5/1958 Hunn
3,379,812 A 4/1968 Yakovou
3,426,122 A * 2/1969 Gaudelli et al. ..... 264/297.9
3,475,265 A 10/1969 Santry
3,694,533 A * 9/1972 Kelsey ..... 264/511
3,883,627 A 5/1975 Fitts
3,950,477 A 4/1976 Di Giacomo
4,002,708 A * 1/1977 Lott ..... 264/42
4,160,003 A 7/1979 Kozuka et al.
4,656,722 A 4/1987 Armstrong
4,668,451 A 5/1987 Langson
(Continued)

FOREIGN PATENT DOCUMENTS

EP 0 936 040 8/1999
(Continued)

OTHER PUBLICATIONS

Candyland Crafts 1 (www.candylandcrafts.com/designerboxindex.htm) published Dec. 11, 2005, obtained Apr. 6, 2009.*
(Continued)

*Primary Examiner* — Jennifer C McNeil
*Assistant Examiner* — Lauren Robinson
(74) *Attorney, Agent, or Firm* — Alston & Bird LLP

(57) ABSTRACT

A mold for manufacturing a corner-shaped simulated stone product has a mold cavity configured to imprint a stone texture on at least a first side face and a front face of the corner-shaped product. The mold also provides a back face with a desirable molded interior angle. The mold cavity can have a flexible edge around a perimeter of the mold cavity to impart a textured surface to a second side face of the corner-shaped product.

3 Claims, 5 Drawing Sheets

U.S. PATENT DOCUMENTS

| | | | | |
|---|---|---|---|---|
| 4,702,877 | A | 10/1987 | Davis, Jr. | |
| 4,847,026 | A | 7/1989 | Jarboe et al. | |
| 4,865,783 | A | 9/1989 | Ahonen et al. | |
| 4,940,558 | A | 7/1990 | Jarboe et al. | |
| 4,944,907 | A | 7/1990 | Davis, Jr. | |
| 4,960,622 | A | 10/1990 | Jarboe et al. | |
| 5,131,202 | A * | 7/1992 | Ball | 52/596 |
| 5,213,747 | A | 5/1993 | Lippert | |
| 5,225,134 | A | 7/1993 | Nasvik et al. | |
| 5,232,646 | A | 8/1993 | Nasvik et al. | |
| 5,250,250 | A | 10/1993 | Gorski | |
| 5,372,676 | A | 12/1994 | Lowe | |
| 5,395,577 | A | 3/1995 | Gorski | |
| 5,435,959 | A | 7/1995 | Williamson et al. | |
| 5,443,774 | A | 8/1995 | Kluh et al. | |
| 5,536,557 | A | 7/1996 | Nasvik et al. | |
| 5,543,100 | A | 8/1996 | Kluh et al. | |
| 5,624,615 | A | 4/1997 | Sandorff | |
| 5,632,922 | A | 5/1997 | Nasvik et al. | |
| 5,667,200 | A | 9/1997 | Kelley, Jr. | |
| 5,787,667 | A | 8/1998 | Sheahan et al. | |
| 5,911,927 | A | 6/1999 | Roberts | |
| 6,355,193 | B1 | 3/2002 | Stott | |
| 6,634,617 | B2 | 10/2003 | Potvin | |
| 6,640,411 | B1 | 11/2003 | Martin et al. | |
| 6,676,872 | B2 * | 1/2004 | Story et al. | 264/219 |
| 6,726,864 | B2 | 4/2004 | Nasr et al. | |
| 2001/0020669 | A1 | 9/2001 | Potvin | |
| 2004/0234771 | A1 * | 11/2004 | Meyer et al. | 428/412 |
| 2007/0045897 | A1 * | 3/2007 | Alexander et al. | 264/225 |

FOREIGN PATENT DOCUMENTS

| | | |
|---|---|---|
| GB | 10458 | 12/1909 |

OTHER PUBLICATIONS

Candyland Crafts 2 (www.candylandcrafts.com/designerboxesletters numbers.htm) published Dec. 11, 2005, obtained Apr. 6, 2009.*

Candyland Crafts 3 (www.candylandcrafts.com/images/L5LettersGHIJKL.gif) published Dec. 11, 2005, obtained Apr. 6, 2009.*

RachelsSupply.com (www.rachelssupply.com/cmold.htm) published Dec. 17, 2005, obtained Apr. 6, 2009.*

MYOM (http://www.makeyourownmolds.com) published Dec. 4, 2004.*

US Office Action dated May 21, 2009, U.S. Appl. No. 11/933,182.

Applicants Submission dated Jun. 22, 2009 for U.S. Appl. No. 11/933,182.

US Office Action dated Sep. 8, 2009, U.S. Appl. No. 11/933,182.

Applicant's Submission dated Jan. 4, 2010 for U.S. Appl. No. 11/933,182.

* cited by examiner

FLAT MOLD FOR CORNER-SHAPED SIMULATED STONE PRODUCTS

TECHNICAL FIELD AND INDUSTRIAL APPLICABILITY OF THE INVENTION

The present invention relates to a mold useful for manufacturing corner-shaped simulated stone products.

BACKGROUND OF THE INVENTION

Simulated stone products include simulated stone veneers and simulated stone architectural trim products. Simulated stone veneers are used as a lightweight veneer facing on masonry, and on metal framed or wood framed construction for architectural aesthetics. The products can be used for exterior applications such as building walls or interior applications such as fireplaces. Simulated stone architectural trim products include capstones, hearthstones, keystones, trim stones and the like. The simulated stone products are usually lower in cost than the natural stones that they replace. CULTURED STONE® products are simulated stone products manufactured by Cultured Stone Corporation, a division of Owens Corning, Napa, Calif. The CULTURED STONE® product line includes hundreds of designs of precast stone veneers and architectural trim products that replicate an extensive variety of textures, sizes, shapes and colors of natural stone. The products are manufactured using molds taken from natural stones. The molds generally include a mold cavity that is filled with a castable material. After the castable material has cured, or set, the flexible layer is stretched or distorted to remove the simulated stone products from the mold.

It is especially desired to have many types and shapes of simulated stone products. Corner stone products, however, are especially difficult and often expensive to make. Simulated stone corner stone product have a more complicated shape than flat stone products and have more surfaces that are visible when the corner stone product is installed. It is difficult to economically make a simulated stone corner produce since the mold itself and the molding/unmolding labor costs greatly exceed those for flat stone products.

SUMMARY OF THE INVENTION

A mold for manufacturing a simulated corner stone product has a mold cavity with a bottom configured to imprint a stone texture on a first side face of the corner stone product; an outer sidewall configured to imprint a stone texture on a front face of the corner stone product; and, an inner sidewall configured to provide a back face of the corner stone product with a desirable molded interior angle.

In certain embodiments, the mold cavity has a flexible edge around a perimeter of the mold cavity for imparting a textured surface to at least an outer edge of a second side of the simulated corner stone product.

Various advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1A:
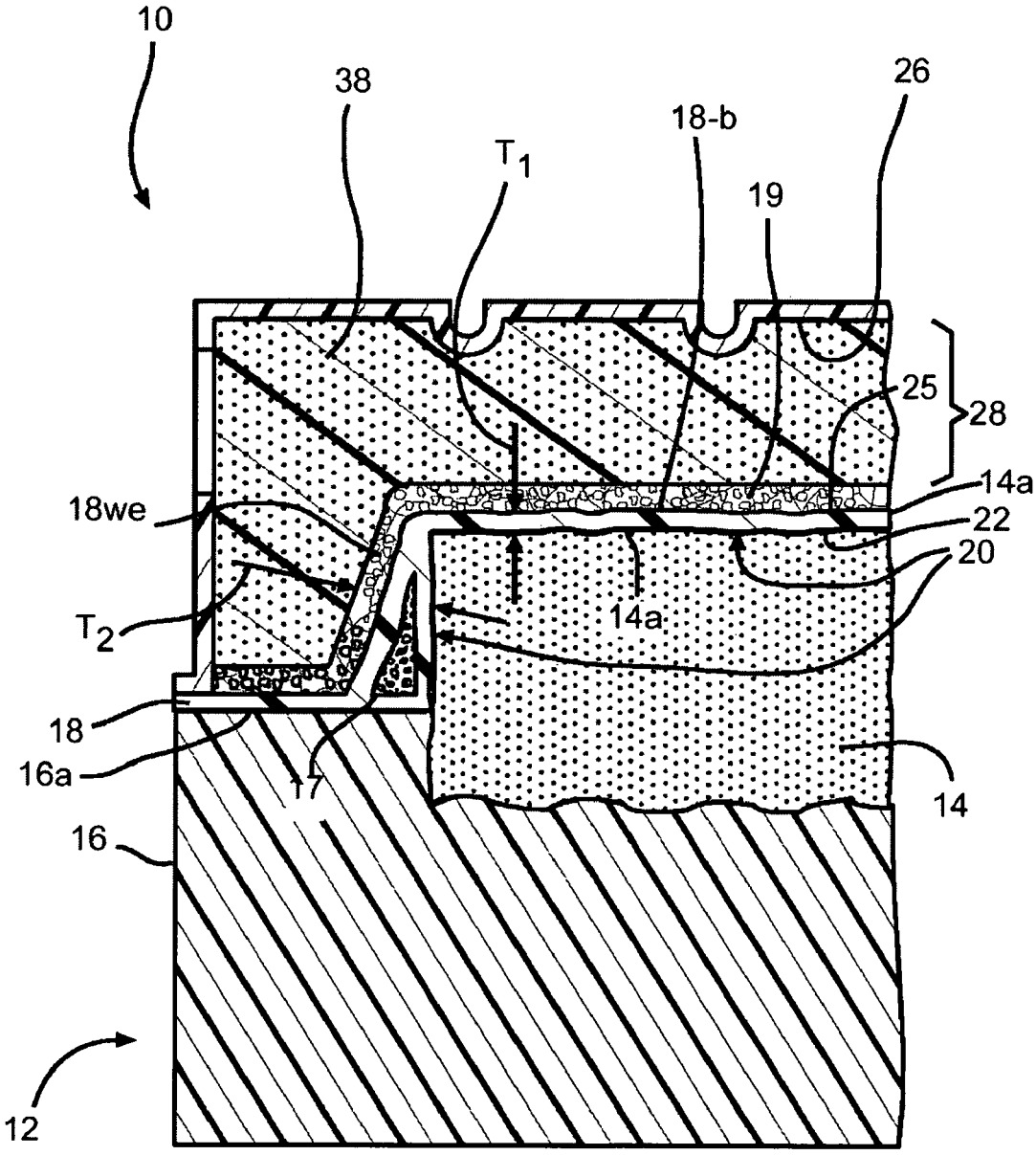
FIG. 1A is a schematic illustration showing a partial, cross-sectional, view of one embodiment of a master mold and a production mold.

The corner-shaped simulated stone products can be in the form of corner pieces, hearth pieces and architectural trim products. In certain embodiments, especially suitable simulated corner stone products include the following types of materials that are made by Owens Corning, Inc: Cultured Cornerstone® Textures: Southern Ledgestone, Country Ledgestone, and Drystack Ledgestone. Further, depending on the height of the corner stone, the flat mold method of production is also especially useful for making: Limestone, Weather Edge Ledgestone, Pro-fit Ledgestone, Carolina Ledgestone and Cobblefield® stone.

A corner-shaped stone mold apparatus 10 includes a master mold 12 which is produced by setting natural corner stones 14 in a base 16. The corner-shaped stones 14 are selected based on size, lack of defects, and shape. The corner-shaped stones 14 are placed in an optimal arrangement on the base 16 so that the corner-shaped stones 14 protrude from a top surface 16*a* of the base 16. The corner-shaped stones 14 are positioned on the base 16 so that the corner-shaped stone 14, when viewed from above has a general L-shape.

Increased manufacturing capacity is achieved since each mold contains a greater square footage of corner-shaped stones per mold than previous molds. The molding of corner-shaped stones using the production mold and the method described herein also decreases cycle time, increases corner-shaped mold cleanliness, decreases the scrap rate (both wet and dry), and provides a longer production mold life.

Generally, the master mold 12 is made by pouring a curable urethane resin or similar curable base 16 around the natural corner-shaped stones 14, and allowing the urethane to cure to set the corner-shaped stones 14 in the base 16. At least one flexible layer 18 is applied over a top surface 14*a* of the natural corner-shaped stones 14 and a top surface 16*a* of the base 16. The flexible layer 18 conforms to the shape of the natural corner-shaped stones 14, closely following any contours in the stone 14.

The flexible layer 18 can be made from one or more layers of a suitable flexible material and can be applied by any suitable method. The flexible layer 18 conforms its shape around the natural corner-shaped stones 14 and retains that shape when the flexible layer 18 is removed from the master mold 12 and is in use. In one embodiment, the flexible layer 18 includes a curable elastomeric or rubber material such as latex or silicone rubber.

In certain embodiments, a mold support 26 is used to hold the flexible layer 18. The mold support 26 can include a backing layer 19 which substantially covers a back surface 25 of the flexible layer 18. The backing layer 19 is applied such that the backing layer 19 also conforms to the shape of the natural corner-shaped stones 14, closely following their contours. In certain embodiments, the backing layer 19 comprises a porous material such as, for example, a breathable mesh material or a polyurethane-fiberglass applied non-woven mat material.

The mold support 26 is positioned over the flexible layer 18; or, if the backing layer 19 is present, over the backing layer 19. A gap or space 28 remains between the mold support 26 and the flexible layer 18, or the backing layer 19, when present. In the illustrated embodiments, a structural material 38 fills the space 28 between the mold support 26 and the backing layer 19. The structural material 38, when hardened, provides support to the flexible layer 18. The structural material 38 can be introduced by any suitable means. It is desired that the cured structural material 38 be a load supporting material capable of providing structural strength. Any suitable type of structural material can be used in the manufacturing method. Some examples include foams such as polyurethane, polystyrene and polyphenylene oxide; many other types of structural materials can be used.

Figure 1B:
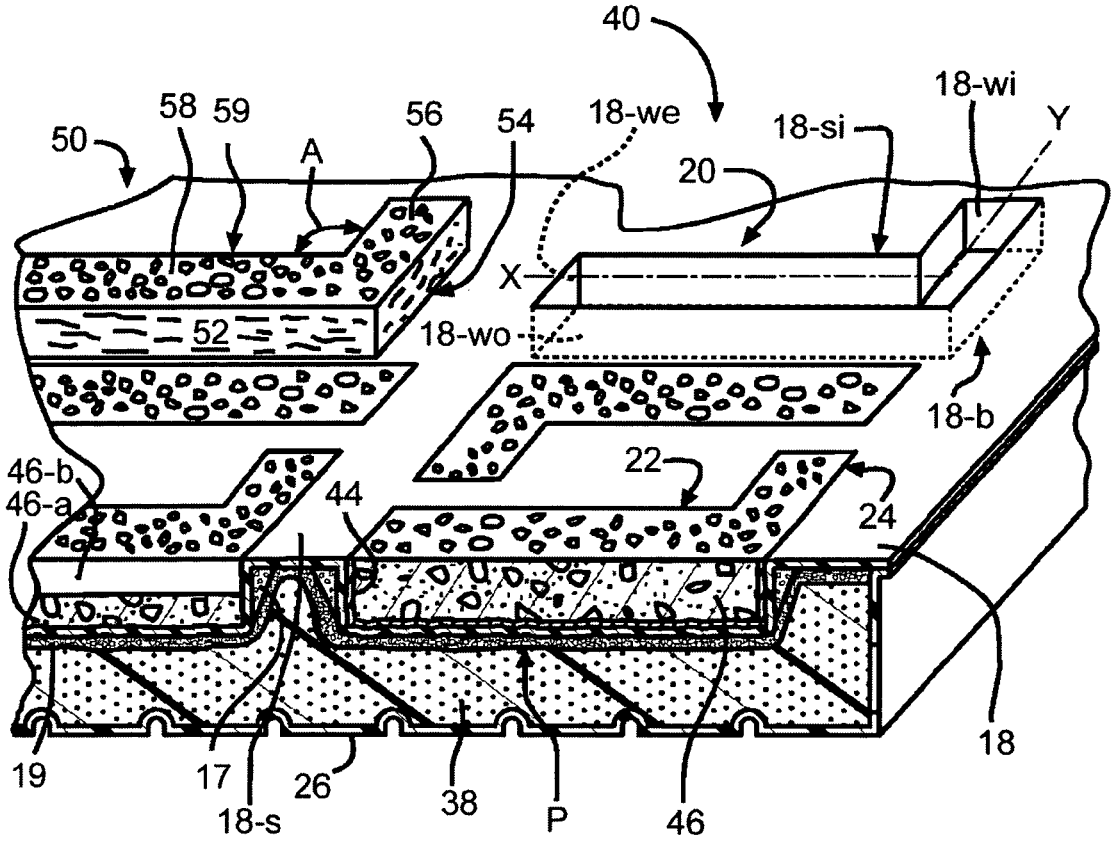
FIG. 1B is a schematic illustration showing a partial, perspective view, partially in phantom, of a production mold showing: an empty mold cavity; a castable material introduced into another mold cavity; two castable materials introduced into another mold cavity; and, a corner stone product formed from the production mold.

After the structural material 38 has cured, the master mold 12 (stone 14 and base 16) is removed, thus providing a production mold 40, as shown in FIG. 1B, which comprises the flexible layer 18, the backing layer 19, the structural material 18 and the mold support 26. The production mold 40 is then inverted for use. The flexible layer 18 retains its shape after removal from the master mold 12 and the corner shapes of the mold cavities 20 are retained in the flexible layer 18. Each mold cavity 20 has the imprinted shape of the corresponding natural corner-shaped stone 14.

Each mold cavity 20 has a corner shape with a first section 22 (having a first longitudinal axis X) that is in communication with a second section 24 (having a second longitudinal axis Y). The first and second sections 22 and 24 are in the same planar orientation, as defined by the axes X and Y. In the embodiment shown, the first and second sections 22 and 24 are at substantially a right angle and have different lengths. In certain embodiments, where the first and second sections 22 and 24 have different lengths, the first section 22 can be two to four or more times longer than the second section 24. In other embodiments, the first and second sections 22 and 24 have substantially the same length. Also, in certain embodiments, the first and second sections 22 and 24 can be positioned at an angle other than a right angle, while still remaining in the same planar orientation.

As shown in FIG. 1B, each mold cavity 20 is defined by a bottom mold cavity section 18-*b*, an inner sidewall 18-*wi*, an outer side wall 18-*wo*, and end walls 18-*we*. The end walls 18-*we* extend between the inner sidewall 18-*wi* and the outer sidewall 18-*wo*. The mold cavity bottom 18-*b*, the mold cavity sidewalls 18-*wi* and 18-*wo*, and the end walls 18-*we* have a stone textured surface. As further shown in FIG. 1B, the mold cavity has a top opening for the introduction of the castable material.

In certain embodiments, the flexible layer 18 also has support sections 18-*s* which are defined by the areas surrounding the mold cavity sidewalls 18-*w* and the mold cavities 20. In the embodiment shown in FIG. 1B, the support sections 18-*s* generally have a flexural modulus that is stiffer or more rigid than the flexural modulus of the mold cavity bottom 18-*b*, the end walls 18-*we*, and the mold cavity sidewalls 18-*wo* and 18-*wi*.

In certain embodiments, as shown in FIG. 1A, the mold cavity bottom 18-*b* can have a relatively thin first thickness, T1. In certain embodiments, the bottom thickness, T1, can be between about ⅛ inch and about ⅜ inches. Also, in certain embodiments, the mold cavity sidewalls 18-*w* can have a relatively thicker, second thickness, T2. In certain embodiments, the sidewall thickness, T2, can have a second thickness T2 that is greater than the first thickness T1.

Also, in certain embodiments, the flexible layer 18 has a reinforcing material 17 added to, or within, the sidewalls 18-*w*. The reinforcing material 17 reinforces the sidewalls 18-*w*, yet allows the sidewalls 18-*w* to still retain the desired flexibility. In certain embodiments, the reinforcing material 17 can be a paste-like material comprising, for example, a latex material, ground up rubber tire, sawdust, and MgO composition. Also, other suitable materials can be used.

Referring now to FIG. 1B, various stages that occur in the production of the corner-shaped stone are schematically illustrated. FIG. 1B shows the mold support 26, the structural material 38 and the backing layer 19 which provide support to the flexible layer 18. In certain embodiments, at least portions of each mold cavity 20 are painted with one or more layers 44 of suitable stone-colored paints. In certain embodiments, especially where the flexible layer 18 has deep and/or narrow walls 18-*w*, the painting can be done by inflating the flexible layer 18 to open up the mold cavity 20.

A castable material 46 is introduced into the mold cavities 20. The castable material 46 can be introduced by any suitable means, such as by pouring the castable material 46 into the mold cavities 20. In certain embodiments, the flexible layer 18 may be vibrated after the castable material 46 substantially fills the mold cavities 20 to insure that the castable material 46 flows into all the contours of each mold cavity 20.

It is to be understood that any suitable castable material 46 can be used for producing the corner-shaped simulated stone products. In one embodiment, the castable material 46 is a lightweight concrete material comprising Portland cement, lightweight aggregates and mineral oxides. However, other castable materials are also useful, such as plaster of Paris or a ceramic material.

Upon hardening, the castable material 46 in each of the mold cavities 20 becomes a corner-shaped stone product 50, as shown in the upper left of FIG. 1B. After hardening, the corner-shaped stone product 50 is then removed from the mold cavities 20 in a suitable manner.

In certain embodiments, the corner-shaped stone product 50 is at least partially dislodged from the mold cavity 20 by flexing the flexible layer 18 to force the corner-shaped stone product 50 from its mold cavity 20. In certain embodiments, a pressurized fluid, such as air, is introduced between the flexible layer 18 and the mold support 26. In embodiments where the flexible layer 18 includes support sections 18-*s*, the support sections 18-*s* of the flexible layer 18 are at least partially restrained from being stretched or distorted by the pressurized fluid. The mold cavity bottom 18-*b*, the end wall 18-*we* and inner and outer sidewalls 18-*w*- and 18-*wo* are stretched or flexed, thereby lifting the corner-shaped stone product 50 from its mold cavity 20. In embodiments where the porous backing layer 19 is present, the pressurized fluid passes through the porous backing layer 19 and the flexible layer 18.

The corner-shaped stone product 50 has a textured front face 52, a textured first side face 54, and textured end faces 56. The textured front face 52 and the textured first side 54 of the corner-shaped stone product 50 are formed by the textured outer sidewall 18-*wo* of the mold cavity 20. Also, the textured end faces 56 are is formed by the textured ends 18-*we* of the mold cavity 20. When the corner-shaped stone product 50 is installed, the textured stone faces 52, 54 and 56 present an aesthetically pleasing appearance.

The corner-shaped stone product 50 also has an interior or back face 59 and a second side face 58. The inner sidewalls 18-*wi* provide the back face 59 of the corner-shaped stone product 50 with a desirable molded interior angle A. The back face 59 of the corner-shaped stone product 50 has a relatively exact interior angle which does not require any extra labor to screed (i.e., either clean or remove) any unwanted molded castable material from the interior angle A of the corner-shaped stone product 50.

The molded interior angle A eliminates the extra processing steps that had previously been needed in other castable corner-shaped stones where the interior angle had to be cleaned and/or straightened. In the past, the excess castable material was manually removed from the interior corner of the stone products by workers who had to strikeoff, or screed, the castable material before the castable material set or cured. By eliminating the need for workers to perform extensive screeding operations to form corner-shaped stones, the present invention provides a safer and more efficient process.

In certain embodiments, a textured, or simulated, stone appearance is also desired for the second side face 58 of the corner-shaped stone product 50, since the second side face 58 is untextured and often shows the aggregate materials within the castable material 46. There are certain situations when the untextured surface of the second side face 58 may be visible upon close observation.

Figure 3:
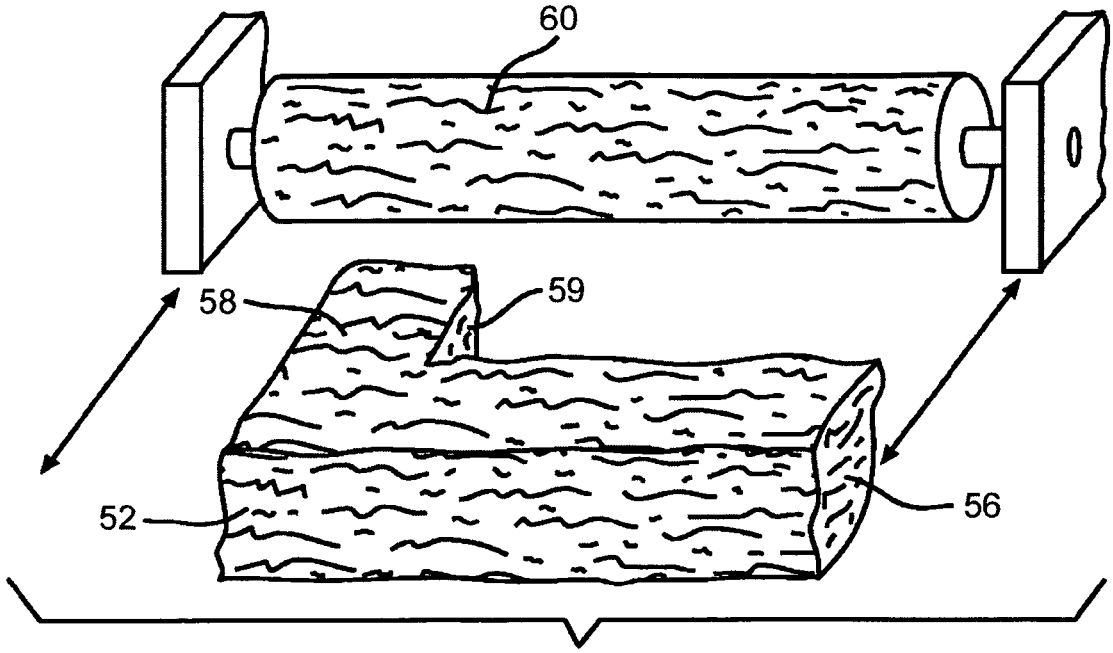
FIG. 3 is a schematic illustration of a texturing device for a corner-shaped simulated stone product.

A textured surface can be formed on the second side face 58. In one embodiment, as shown in FIG. 3, an imprint mold member 60 is used on the castable material 46 before it is set to provide an additional stone-like appearance to the second side face 58. The imprint mold member 60 is mounted for rotation on the castable material. In certain embodiments, the imprint mold member 60 can have a stone-like texture. The imprint mold member 60 can be made of any suitable material, such as where a urethane, latex or silicone rubber material. The texture of the imprint mold can be cast from natural stone.

The textured material can be used to apply the desired texture in various ways. In one embodiment, once the castable material 46 starts to cure, the textured material is used to impart the desired texture on the second side face 58. In another embodiment, the textured roll can be used to transfer a texture to the wet castable material before the castable material cures.

In certain other embodiments, the textured material 60 is placed over the castable material 46 during the vibration step of the molding process. As the castable material 46 is vibrated, the pattern of the textured material 60 is imprinted on the second side face 58 of the castable material 46. In certain other embodiments, the textured material 60 can be an elastomeric, or rubber-like, material or can be a plastic sheet temporarily laid against the second side face during the curing to form a somewhat smooth surface for the second side face 58.

The aesthetics can also be further enhanced in another embodiment where a post-screeding painting step is used to apply paint on the second side face 58 after the flexible layer 18 has been filled and screed, but before any settling or vibrating step. The paint provides a generally uniform color on the second side face 58, and the subsequent vibration step blends the paint into the castable material 46. In certain embodiments, the post-screeding paints can be low-viscosity paints which are readily dispersed into the second side face 58.

In another embodiment, paint is applied to the untextured second side face 58 after the vibration step. In such embodiments, the paint can be a high viscosity paint which smoothes the second side face 58 and reduces the visual awareness of the aggregates.

In still another embodiment, a desired, and somewhat excess, amount of paint 44 is applied to one or more of the bottom 18-*b*, the inner sidewalls 18-*wi*, the outer sidewalls 18-*wo*, and/or the end walls 18-*we* before the mold cavity 20 is filled with the castable material 46. The extra amount of paint 44 within the mold cavity 20 causes a supply of paint 44 to remain, or puddle, in the bottom of the mold cavity 20. When the mold cavity 20 is filled with the castable material 46 and then vibrated, the paint 44 migrates along the sidewalls 18-*wi* and 18-*wo* and the end walls 18-*we* of the mold cavity 20. The paint 44 flows, or oozes, onto at least an outer perimeter (i.e., the outer areas of the surface) of the second side face 58 of the corner-shaped stone product 50, creating a painted second side face 58. Since the perimeter of the second side face 58 is one of the points of visual contact on the installed wall of stone product 50, there is an aesthetically pleasing appearance to the corner-shaped stone product 50.

In yet another embodiment, as schematically illustrated in FIG. 1B, more than one type of castable material is used in the mold cavity 20. First, an underpouring of a first castable material 46-*a* is made in the mold cavity 20. The mold cavity 20 is not completely filled with the first castable material 46-*a*. The first castable material 46-*a* can comprise a first aggregate-containing castable material. Then, a second castable material 46-*b* is made on top of the aggregate-filled, first castable material 46-*a*. The second castable material 46-*b* is a substantially aggregate-free castable material which provides an aesthetically pleasing corner-shaped stone product 50.

Figure 2A:
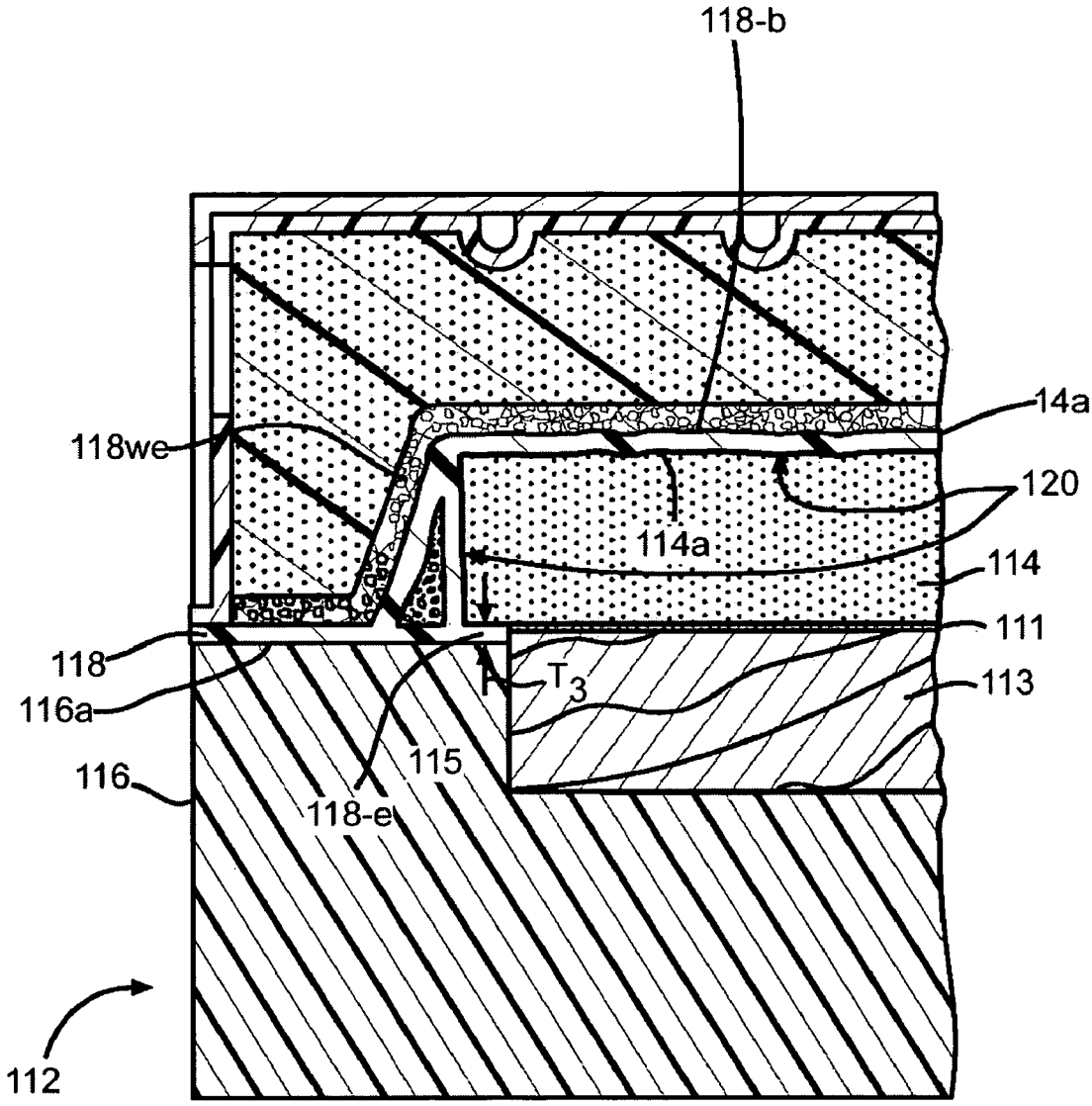
FIG. 2A is a schematic illustration showing a partial, cross-sectional, view of another embodiment of a master mold and a production mold.
Figure 2B:
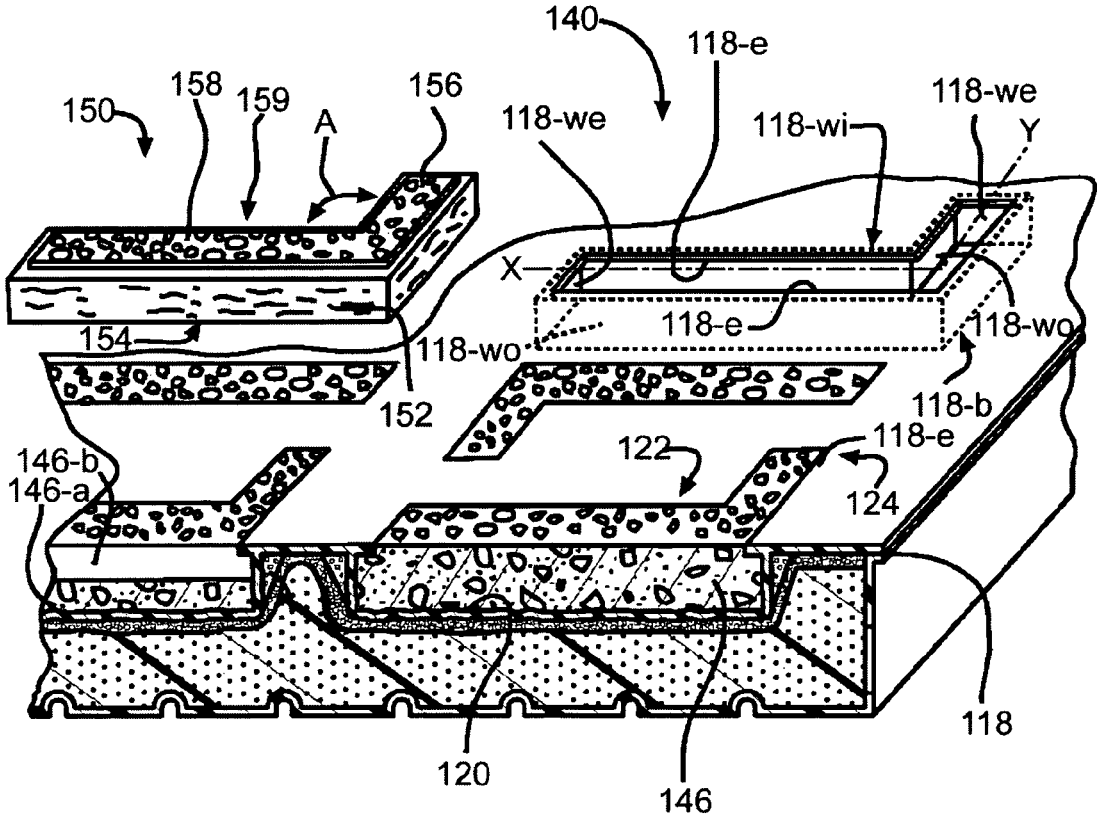
FIG. 2B is a schematic illustration showing a partial, perspective view, partially in phantom, of a production mold showing: an empty mold cavity; a castable material introduced into another mold cavity; two castable materials introduced into another mold cavity; and a corner stone product formed from the production mold.

Another embodiment is shown in FIGS. 2A and 2B. It is to be noted that where features are the same as for the embodiments in FIGS. 1A and 1B, such features are not further described herein in detail. A master mold 112 is made by pouring a curable urethane or other curable base 116 around a pedestal 113, and allowing the base 116 to cure or set the pedestal 113 in the base 116. A natural corner-shaped stone 114 is positioned on each spacer pedestal 113. In certain embodiments, the stone 114 can be adhered to the pedestal 113 with a suitable adhesive material 111. The spacer pedestal 113 has a perimeter that is slightly smaller than at least a portion of the bottom perimeter of the natural stone 114. The difference between the perimeter of the pedestal 113 and the bottom perimeter of the natural stone 114 forms a perimeter opening 115 surrounding the stone 114, as shown by a third thickness, $T_3$, in FIG. 2A.

At least one flexible layer 118 is applied over a top surface 114*a* of the natural corner-shaped stones 114 and a top surface 116*a* of the base 116. The flexible layer 118 conforms to the shapes of the natural corner-shaped stones 114, closely following any contours in the stone 114 and forming an imprinted corner-shaped stone shape and texture in the flexible layer 118.

In the embodiment illustrated in FIG. 2B, a production mold 140 is shown as including the flexible layer 118 and the mold cavities 120. Each mold cavity 120 is defined by a bottom mold cavity section 118-*b*, end walls 118-*e*, the inner and outer sidewalls 118-*wi* and 118-*wo*, and the perimeter edge 118-*we*. The end walls 118-*we* extend between the inner sidewall 118-*wi* and the outer sidewall 118-*wo*.

The flexible layer 118 also substantially fills the perimeter opening 115 surrounding each spacer pedestal 113, thus forming a lip, or overhanging, perimeter edge 118-*e*. The perimeter edge 118-*e* thus also has the imprinted shape of the natural stone 114. In certain embodiments, the perimeter edge 118-*e* can have a relatively thin thickness, T3; for example, the edge thickness, T3, can be between about ⅛ inch and about ⅜ inches.

In certain embodiments, the perimeter edge 118-*e* extends substantially around the entire upper perimeter of the mold cavity 120. In such embodiments, the perimeter edge 118-*e* extends in an inward direction from upper edges of the outer sidewall 118-*wo*, the inner sidewall 118-*wi*, and the end walls 118-*we*.

In other embodiments, the perimeter edge 118-*e* partially extends around the upper perimeter of the mold cavity 120. The perimeter edge 118-*e* extends in an inward direction from upper edges of the outer sidewall 118-*wo* and at least a portion of the end walls 118-*we*. In such embodiments, the perimeter edge 118-*e* provides the textured, or simulated, stone texture to at least those portions of the second side face 158 that would be visible once the stone product 150 is installed.

A castable material 146 is introduced into each mold cavity 120 having a corner shape with a first section 122 (having a first longitudinal axis X) that is in communication with a second section 124 (having a second longitudinal axis Y).

Upon hardening, the castable material 146 in each of the mold cavities 120 becomes a corner-shaped stone product 150. The perimeter edge 118-*e* is sufficiently thin and flexible to allow the corner-shaped mold product 150 to be easily removed from the mold cavity 120.

The corner-shaped stone product 150 has a textured front face 152, a textured first side face 154 and textured end faces 156. The textured front face 152 of the mold product 150 is formed by the textured outer sidewall 118-*wo* of the mold cavity 120. Likewise, the textured first side face 154 is formed by sidewalls 118-*wo* of the mold cavity 120. Likewise, the textured first end faces 156 are formed by the textured ends 118-*we* of the mold cavity 120.

The corner-shaped stone product 150 also has a back face 159. The inner sidewalls 118-*wi* provide the back face 159 of the corner-shaped stone product 150 with a desirable molded interior angle A.

The corner-shaped stone product 150 also has a partially textured second side 158. The perimeter edge 118-*e* provides a textured stone appearance around at least a perimeter portion of the second side face 158 of the corner-shaped stone product 150.

In certain embodiments, the partially textured surface of the second side face 158 is adjacent to the front face 152. In other embodiments the partially textured surface of the second side face 158 extends around at least a portion of a perimeter of the second side face 148. In still other embodiments, the partially textured surface of the second side face 158 extends substantially around the perimeter of the second side face 158.

In yet another embodiment, as also schematically illustrated in FIG. 2B, more than one type of castable material is used; i.e., there is a double pour of castable materials. First, an underpouring of a first castable material 146-*a* is made in the mold cavity 120. The mold cavity 120 is not completely filled with the first castable material 146-*a*. The first castable material 146-*a* can comprise an aggregate-containing castable material. Then, a second castable material 146-*b* is made on top of the aggregate-filled, first castable material 146-*a*. The second castable material 146-*b* is a substantially aggregate-free castable material on the second side face 158 which, along with the textured perimeter, provides an aesthetically pleasing corner-shaped stone product 150.

Figure 4:
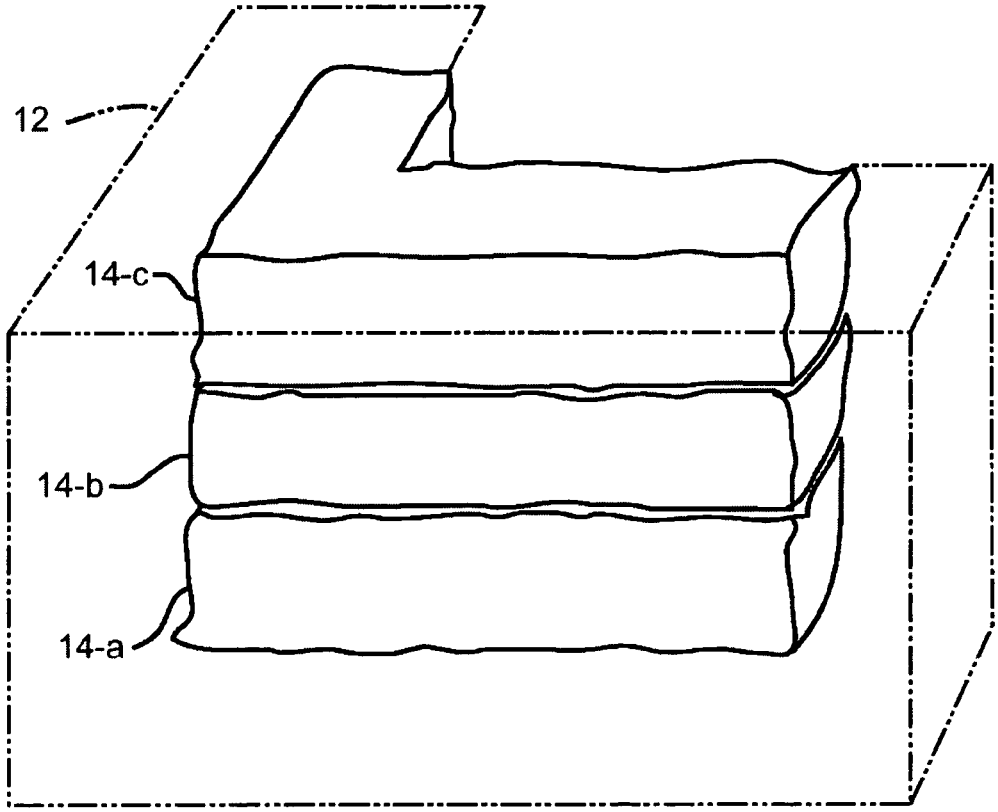
FIG. 4 is a schematic illustration of multiple stones stacked together in a master mold (shown in phantom).

Referring now to FIG. 4, another embodiment is shown. A mold 12 comprises a pre-mortared, or drystack, set of two or more adjacently positioned stones, shown as 14-*a*, 14-*b*, 14-*c*. When the drystack corner-shaped stone products are made, the drystack (made of multiple corner-shaped stones) is demolded as one piece. The stones are cast in an adjacent position such that a corner-shaped molded simulated stone product has the look of a stack of corner-shaped stones. In using this multiple stacked corner-shaped stone production mold, the throughput is greatly increased.

While the invention has been described with reference to a preferred embodiment, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A mold for manufacturing simulated stone products, the mold comprising: a flexible layer having the form of a natural stone, the flexible layer being configured to define a plurality of corner-shaped mold cavities, and a portion of the flexible layer being in the form of support sections dividing the mold into the individual corner shaped mold cavities; wherein each corner-shaped mold cavity has a first mold section in communication with a second mold section, the first mold section being oriented at a desired interior angle with respect to the second mold section, the first mold section having an inner side wall, an outer side wall, a bottom wall, and an end wall forming a top opening, the second section having an inner side wall, an outer side wall, a bottom wall, and an end wall forming a top opening, with the first mold section and the second mold section lying in the same horizontal plane so that castable material can be introduced into the mold cavity through the top opening, the mold cavity further including a perimeter edge extending inwardly around at least a portion of an upper perimeter of the mold cavity, the perimeter edge configured to imprint a stone texture on at least a portion of the corner-shaped stone product;

wherein the inner side walls, outer side walls, bottom walls and the end walls of the mold are configured to imprint onto castable material introduced into the mold a texture that simulates a natural stone texture.

2. A mold for manufacturing simulated stone products, the mold comprising: a flexible layer having the form of a natural stone, the flexible layer being configured to define a plurality of corner-shaped mold cavities, and a portion of the flexible layer being in the form of support sections dividing the mold into the individual corner shaped mold cavities; wherein each corner-shaped mold cavity has a first mold section in communication with a second mold section, the first mold section being oriented at a desired interior angle with respect to the second mold section, the first mold section having an inner side wall, an outer side wall, a bottom wall, and an end wall forming a top opening, the second section having an inner side wall, an outer side wall, a bottom wall, and an end wall forming a top opening, with the first mold section and the second mold section lying in the same horizontal plane so that castable material can be introduced into the mold cavity through the top opening, the mold cavity further including a perimeter edge extending inwardly around at least a portion of an upper perimeter of the mold cavity, the perimeter edge configured to imprint a stone texture on at least a portion of the corner-shaped stone product; wherein the perimeter edge extends from at least the outer sidewall of the mold cavity;

wherein the inner side walls, outer side walls, bottom walls and the end walls of the mold are configured to imprint onto castable material introduced into the mold a texture that simulates a natural stone texture.

3. A mold for manufacturing simulated stone products, the mold comprising: a flexible layer having the form of a natural stone, the flexible layer being configured to define a plurality of corner-shaped mold cavities, and a portion of the flexible layer being in the form of support sections dividing the mold into the individual corner shaped mold cavities; wherein each corner-shaped mold cavity has a first mold section in communication with a second mold section, the first mold section being oriented at a desired interior angle with respect to the second mold section, the first mold section having an inner side wall, an outer side wall, a bottom wall, and an end wall forming a top opening, the second section having an inner side wall, an outer side wall, a bottom wall, and an end wall forming a top opening, with the first mold section and the second mold section lying in the same horizontal plane so that castable material can be introduced into the mold cavity through the top opening, the mold cavity further including a perimeter edge extending inwardly substantially around the upper perimeter of the mold cavity, the perimeter edge configured to imprint a stone texture on at least a portion of the corner-shaped stone product;

wherein the inner side walls, outer side walls, bottom walls and the end walls of the mold are configured to imprint onto castable material introduced into the mold a texture that simulates a natural stone texture.

* * * * *